United States Patent [19]

Vettori

[11] 4,160,576

[45] Jul. 10, 1979

[54] ELECTRIC POWER SUPPLY CONNECTOR ESPECIALLY FOR A FAN OF THE FLAT TYPE

[75] Inventor: Claude Vettori, Neauphle le Chateau, France

[73] Assignee: Etudes Techniques et Representations Industrielles E.T.R.I., Neuilly-sur-Seine, France

[21] Appl. No.: 889,211

[22] Filed: Mar. 23, 1978

[30] Foreign Application Priority Data

Apr. 13, 1977 [FR] France ..... 77 11096

[51] Int. Cl.[2] ..... H01R 13/42

[52] U.S. Cl. ..... 339/119 R; 339/147 R; 339/210 R

[58] Field of Search ..... 339/119 R, 147 R, 147 P, 339/210 R, 210 M

[56] References Cited

U.S. PATENT DOCUMENTS

| | | | |
|---|---|---|---|
| 3,794,952 | 2/1974 | Dowis | 339/147 P X |
| 4,040,703 | 8/1977 | Shaffer | 339/210 R X |

*Primary Examiner*—Joseph H. McGlynn

*Assistant Examiner*—John S. Brown

*Attorney, Agent, or Firm*—Young & Thompson

[57] ABSTRACT

A power supply connector placed within a flat fan housing is mounted externally on a cylindrical shell which forms an axial duct for the fan impeller, the impeller being driven by an electric motor which is attached to the shell by means of radial arms. At least one anchoring block placed within a cavity of the connector is provided with retaining means for an internal portion of each connector terminal which is connected to the motor by means of a conductor placed within a channel of the radial arms. The connector terminal has a projecting external portion which can be connected to a power supply. In the service position, the cavity is closed by a cover-plate which maintains the anchoring block and the end portion of each associated conductor, two complementary portions of the anchoring block being interassembled so as to form a housing for retaining the other portion. At least one complementary portion has projecting claws which are capable of engaging and locking on bosses for retaining the other portion in the service position.

9 Claims, 6 Drawing Figures

FIG. 3
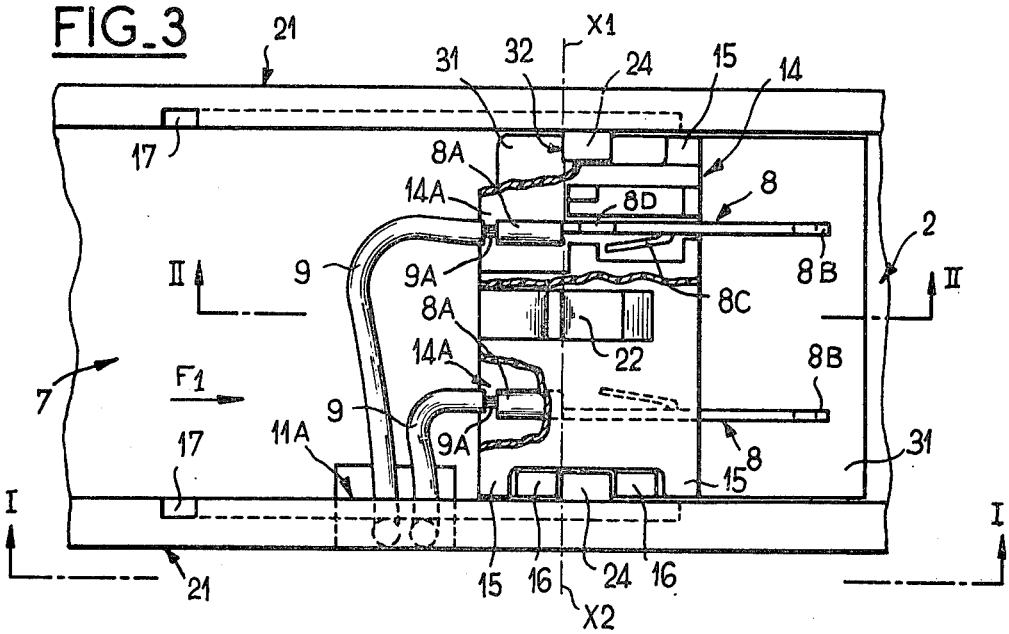
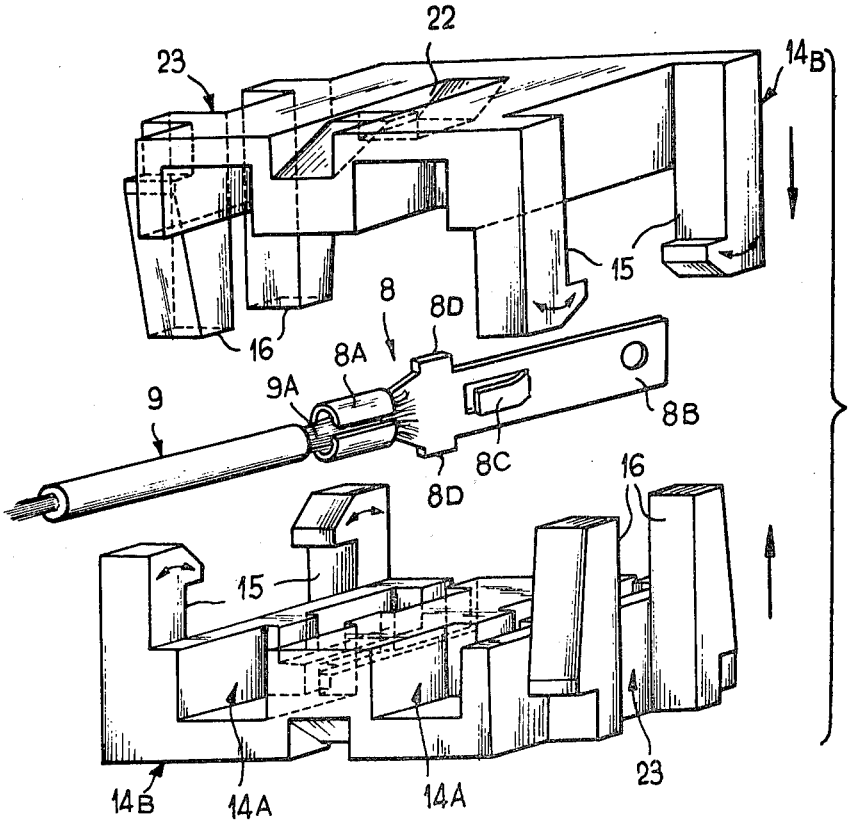
FIG. 4

FIG_5
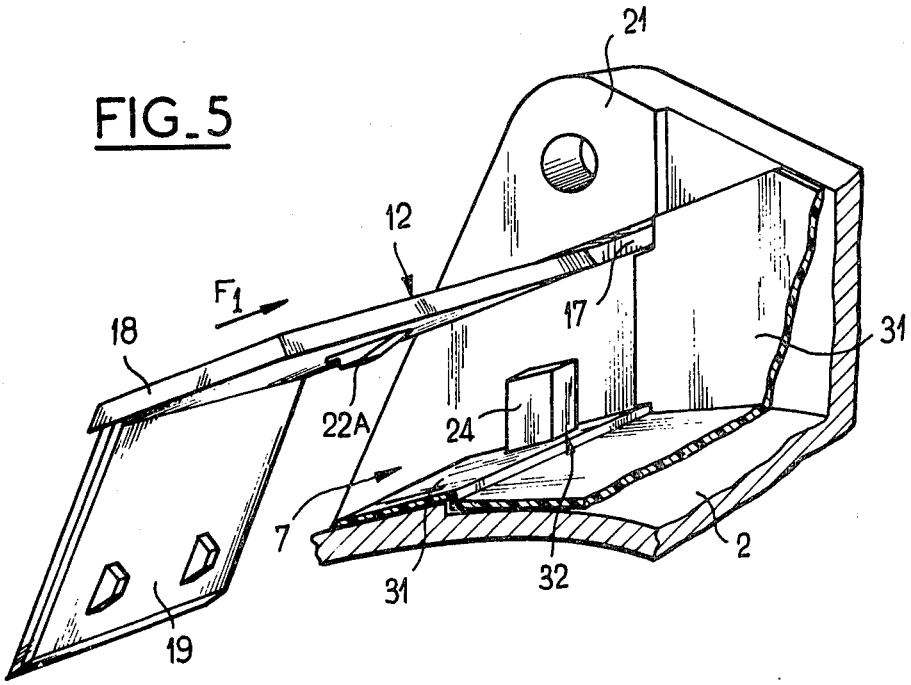
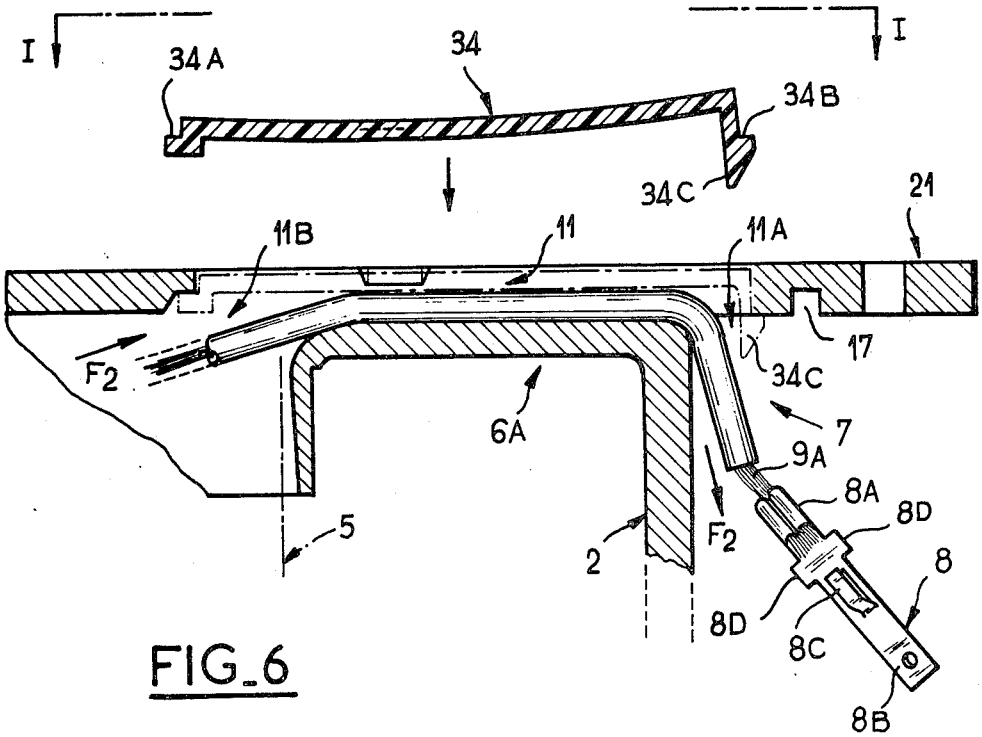
FIG_6

ELECTRIC POWER SUPPLY CONNECTOR ESPECIALLY FOR A FAN OF THE FLAT TYPE

This invention relates to an electric power supply connector, especially for a fan of the flat type provided with a hollow housing and a cylindrical shell which defines an internal axial duct for an impeller, said impeller being driven by an electric motor which is secured to the cylindrical shell by means of substantially radial arms. The connector is mounted externally on the cylindrical shell and provided with a cavity for receiving at least an internal portion of a connector terminal, the terminal being connected to the motor by means of a conductor placed within a channel of one of the radial arms. The connector terminal has a projecting external portion which is provided with means for connecting this latter to an electric power supply.

There are a number of known designs of connectors for fans of the type mentioned above but they are generally subject to a practical disadvantage in regard to the assembly of the fan. It is in fact the customary practice to leave a free end on each supply lead to the motor, this free end being attached to the internal portion of the corresponding connector terminal after this latter has been placed in position. Attachment of the end of the supply lead to the connector terminal which has already been fitted in position is carried out, for example, by means of a clip which is either crimped-on or soldered at the time of assembly of the fan.

The space available for the attachment of each supply lead to the corresponding connector terminal is particularly limited in a fan of the type consisting of a flat housing which has a thickness of only 25 mm, for example, and to which the present invention is primarily applicable. Under normal circumstances this difficulty entails the need to provide an excessive length of supply lead which cannot conveniently be fitted within its housing next to the connector. This results in waste of time in the assembly of the fan as well as fairly frequent electrical faults since the attachment of the lead to the connector terminal frequently proves to be an awkward operation.

The drawbacks recalled in the foregoing are particularly marked in the case of large-scale production of fans for cooling very costly electronic equipment units which are intended to operate over long periods of time without any attendant danger of overheating.

The aim of this invention is to overcome the disadvantages mentioned in the foregoing and to permit of economical mass production of power supply connectors which are easy to mount and offer complete operational safety, especially in the case of fans for cooling electronic assemblies.

The invention is directed to an electric power supply connector, especially for a fan of the flat type comprising a hollow housing and a cylindrical shell defining an axial duct for an impeller, said impeller being driven by an electric motor which is secured to the cylindrical shell by means of substantially radial arms. The connector is mounted externally on the cylindrical shell and has a cavity for receiving at least one anchoring block provided with retaining means for an internal portion of each connector terminal which is connected to the motor by means of a conductor placed within a channel of one of the radial arms. The connector terminal has a projecting external portion which can be connected to an electric power supply, a cover-plate being provided for covering the cavity in the service position as well as maintaining the anchoring block and the end portion of each associated conductor in said position.

In accordance with the invention, the aforesaid connector is characterized in that the anchoring block is made up of two complementary portions which can be interassembled in the service position in order to constitute a housing for retaining the internal portion of each connector terminal. At least one of the complementary portions of the anchoring block is provided with projecting claws which can be engaged and locked on bosses for retaining the other portion in the aforementioned service position.

As will be explained hereinafter in connection with an industrial embodiment of the connector in accordance with the invention, the anchoring block constituted by two complementary and readily assembled portions in turn facilitates the assembly of the connector, especially in the case of a connector of small size having two connector terminals placed in adjacent relation.

By way of example, the two complementary portions of the anchoring block are substantially identical and prismatic; they each comprise two projecting and substantially parallel resilient claws disposed along two edges of a first lateral face of the prism aforesaid, and two projecting retaining bosses on a second lateral prism face remote from the first. The two bosses can be engaged in the service position between the two claws of the other portion of the block, said claws being resiliently locked in position on the bosses.

The two aforesaid complementary portions which are preferably formed of molded plastic material thus constitute the complete anchoring block and retain the internal portion of each connector terminal which has previously been placed within its housing.

By virtue of the arrangements set forth in the foregoing, power supply connectors in accordance with the invention can be economically manufactured and assembled in large-scale production, as will be explained hereinafter.

In a flat ventilating-fan provided with a square housing and two side plates each having four corners located opposite to each other in pairs on each side of the cylindrical shell in order to form a radially extending double frame on said shell, the cavity of the connector is located between two opposite corners of the square side plates. The cover-plate of the cavity has two parallel edges slidably mounted within two parallel grooves formed in the two opposite internal faces of the aforesaid corners of the side plates on each side of the cavity which is intended to receive the anchoring block. The aforesaid grooves are oriented substantially along a plane which is tangent to the wall of the cylindrical shell and transversely to the axis of this latter.

As set forth in the description of an industrial embodiment of the power supply connector in accordance with the invention, the arrangements mentioned are particularly convenient for the economical and efficient production of a flat and compact fan having a supply connector which can easily be mounted and employed with complete safety.

Further distinctive features and advantages of the present invention will be brought out by the following description of a preferred embodiment of the invention which is presented by way of example and not in any limiting sense, reference being had to the accompanying drawings, wherein:

FIG. 3 is a side view of the fan connector of FIG. 2, this view being taken along line III—III;

FIG. 4 is an exploded detail view showing the two complementary portions of the anchoring block of the connector of FIGS. 1 to 3 and showing a connector terminal which is attached to a lead for supplying current to the motor;

FIG. 5 is a perspective view of the sliding cover-plate of the connector of FIGS. 1 and 2;

FIG. 6 is a sectional view taken along line VI—VI of FIG. 1 and showing the channel which is formed in one of the radial arms of the fan and in which are passed the supply leads to the motor, the cover-plate being intended to close said channel.

Figure 1:
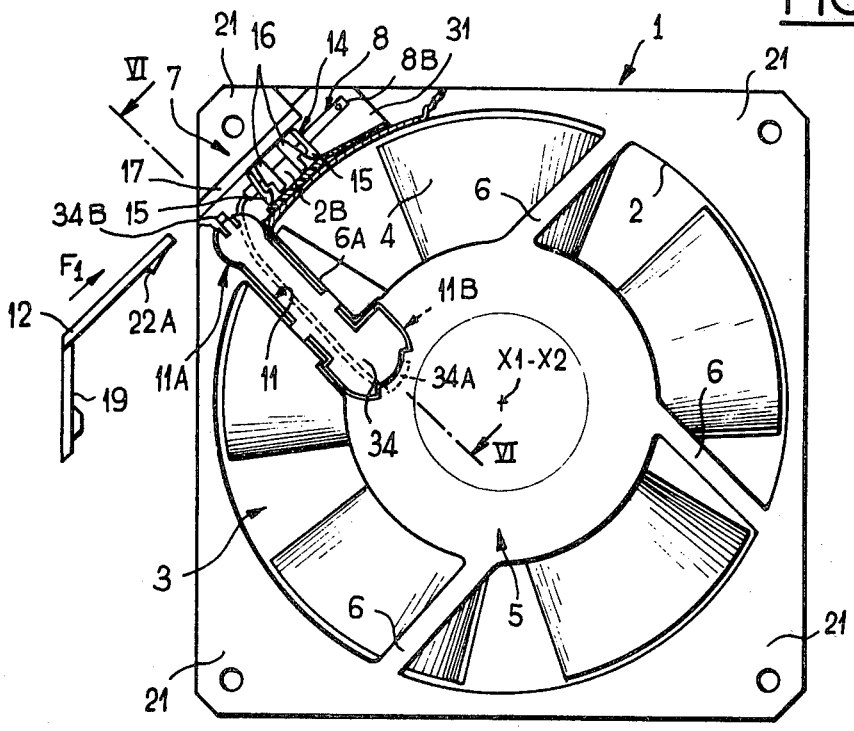
FIG. 1 is an end view of a flat ventilating-fan equipped with a power supply connector in accordance with the invention, with a cutaway portion showing the connector which is placed in one corner of the square housing.

In the embodiment illustrated in FIGS. 1 to 6, the electric power supply connector is designed for a fan 1 of the flat type comprising a hollow housing and a cylindrical shell 2 which defines an internal axial duct 3 for an impeller 4 having an axis X1-X2. Said impeller is driven by an electric motor 5 which is secured to the cylindrical shell 2 by means of substantially radial arms 6.

Figure 2:
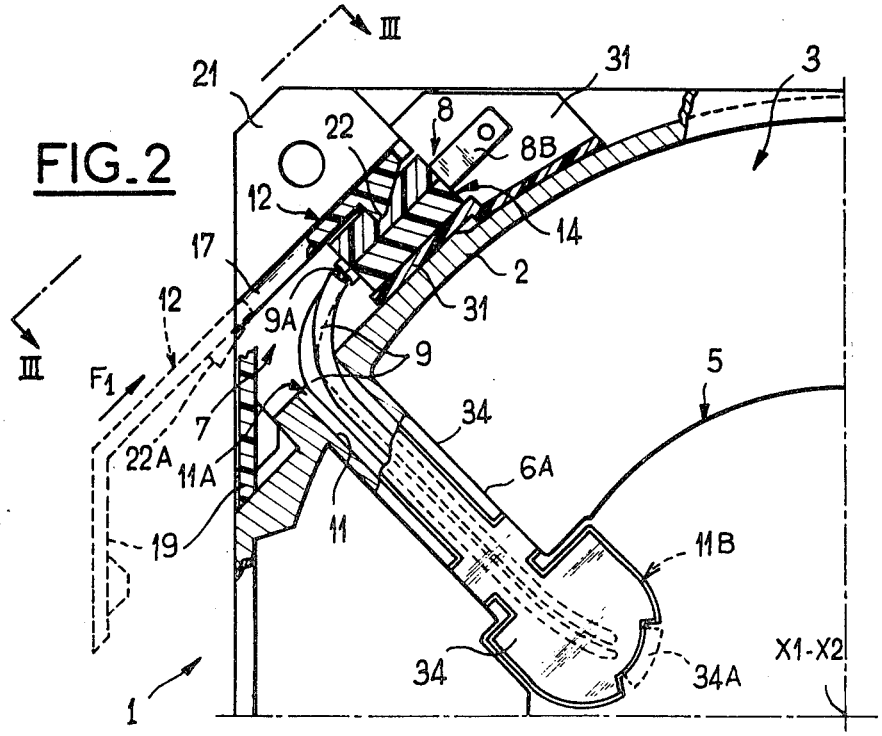
FIG. 2 is an enlarged view of the top left-hand corner of the fan of FIG. 1 and shows the anchoring block of the connector, this view being taken in cross-section along line II—II of FIG. 3.

The connector is mounted externally on the cylindrical shell 2 and is provided with a cavity 7 for receiving (FIGS. 2 and 3) the two internal portions 8A of two connector terminals 8. Said terminals are connected to the electric motor 5 by means of two conductors 9 which are passed within a channel 11 of one of the radial arms 6A. The channel 11 of the radial arm 6A communicates with the cavity of the connector through a passage 11A and communicates through a similar passage 11B with the axial housing of the motor 5 (as shown in FIGS. 2 and 6). Each connector terminal 8 has a projecting external portion 8B which is intended to be connected to a source of electrical energy (not shown) such as a general power supply circuit.

The connector is provided with a removable cover-plate 12 (as shown in FIGS. 1, 2, 6) which is capable of covering the cavity 7 and of being locked thereon in the service position in order to ensure that each connector terminal 8 and the associated end portion 9A of each conductor 9 are maintained in fixed relation in this position.

In accordance with the invention and as shown in FIGS. 1 to 3, the connector is provided for the purpose of anchoring each connector terminal 8 with a removable block 14 having a housing 14A for the internal portion 8A of each connector terminal 8. The anchoring block 14 can be engaged within the cavity 7 of the connector and maintained in position within the cavity by means of the cover-plate 12 in the service position (FIG. 2).

As shown in FIG. 4, the anchoring block 14 advantageously comprises two complementary portions 14B (as shown in FIG. 4) which can be interassembled in the service position in order to form each of the housings 14A and to retain each connector terminal 8 within said housing. To this end, the internal portion 8A of said terminal is provided with a resilient lateral finger 8C and with projecting lugs 8D. As will be explained below, the resilient finger 8C permits rapid introduction of the connector terminal 8 within its housing 14A once the two portions 14B of the anchoring block 14A have been assembled. Bosses of the housing 14A which are associated with the resilient finger 8C and with the lugs 8D then ensure that the connector terminal 8 is secured within the anchoring block 14 in the service position.

At least one of the two complementary portions 14B of the anchoring block 14 is provided with projecting claws 15 which can be engaged and locked on retaining bosses 16 of the other portion 14B of the block 14 in the service position. The two assembled portions 14B thus constitute the complete block 14 in order to retain therein the internal portion 8B of each connector terminal 8 which has previously been placed within its housing 14A.

In the industrial embodiment illustrated by way of example in FIGS. 1 to 4, the two complementary portions 14B of the anchoring block 14 are identical and prismatic. Each portion 14B is provided with two substantially parallel and resilient projecting claws 15 disposed along two edges of one and the same lateral face of the prism aforesaid. Another lateral prism face located on the side opposite to the claws 15 carries two retaining bosses 16 which can be engaged in the service position between the two resilient claws 15 of the other portion 14B of the anchoring block 14.

Each portion 14B of the anchoring block is preferably formed of molded plastic material which makes it possible by elasticity to engage and lock the claws 15 on the bosses 16 of the other associated portion 14B.

Advantageously, the cavity 7 which is intended to receive the anchoring block 14 is provided towards the exterior with two parallel grooves 17 (FIGS. 1 to 3) which are oriented substantially along a plane tangent to the wall of the cylindrical shell 2 and transversely to the axis X1-X2 of this latter. The two grooves 17 are adapted to receive two parallel edges 18 of the cover-plate 12 which is mounted so as to permit sliding displacement in the direction of the arrow $F_1$ within the grooves 17 (as shown in FIGS. 1, 2, 5).

In the embodiment herein described by way of example, the flat ventilating-fan 1 of the type comprising a square housing (as shown in FIGS. 1 and 2) is provided with two side plates each having four corners 21 located opposite to each other in pairs on each side of the cylindrical shell 2. The two square side plates aforesaid form a radially extending double frame on the shell 2. The cavity 7 of the connector is located between two opposite corners 21 of the two side plates. The parallel grooves 17 in which the cover-plate 12 is slidably mounted are formed (FIGS. 1, 2, 3) in the two opposite internal faces of the aforesaid corners 21 on each side of the cavity 7 which is intended to receive the anchoring block 14.

In order to close the cavity 7 containing the anchoring block 4, the sliding cover-plate 12 is advantageously provided with a rear oblique extension 19 located substantially in alignment with the square sides of the fan housing in the service position of the cover-plate 12 (as shown in FIG. 2). On a face which is remote from the cylindrical shell 2, the anchoring block 14 is provided with a retaining recess 22 (FIGS. 2, 3, 4) in which a catch 22A of the cover-plate 12 is capable of resilient engagement in order to maintain said cover-plate locked in the service position on the cavity 7 of the connector as shown in FIG. 2.

Preferably, the catch 22 of the cover-plate 12 is placed near the center of that face of the cover-plate 12 which is located opposite to the anchoring block 14 (as shown in FIG. 5). The cover-plate 12 which has thus been locked in the service position is tightly fitted on the anchoring block 14 and on the cavity 7, thus providing the connector with an undetachable closure element which is impossible to unlock without destruction of the cover-plate (FIG. 2).

Advantageously, the anchoring block 14 has two recessed portions 23 located between the bosses 16 of each identical portion 14B of the block (as shown in FIGS. 1 and 4). Each recessed portion 23 is adapted to receive a lug 24 for maintaining the block in position (as shown in FIG. 4). Said lug is formed on each lateral wall of the cavity 7 of the connector in order to prevent displacement of the anchoring block 14 in the direction of sliding motion of the cover-plate 12 (as indicated by the arrow $F_1$ in FIGS. 1, 2 and 3).

The utilization of the connector in accordance with the invention and as hereinabove described with reference to FIGS. 1 to 6 will now be explained.

The connector is assembled by first preparing the conductors 9 (FIGS. 2, 3, 4, 6) in such a manner that these latter have the exact length required for positioning within the connector cavity 7 the block 14 containing the connector terminals 8 which are attached to the ends 9A of the conductors. This mode of procedure dispenses with any need to form a cumbersome loop at the ends 9A of the conductors which can thus be readily housed within the cavity 7 even if this latter is of small width.

Preferably, the connector terminals 8 have previously been fixed at the ends 9A of the conductors 9 and can rapidly be introduced side by side within their housings 14A of the block 14 (as shown in FIG. 3).

The preliminary assembly of the anchoring block 14 can be carried out with ease by virtue of the resilient locking of the claws 15 of each portion of the block, said claws being engaged over the retaining bosses 16 of the other portion (as shown in FIG. 4).

By virtue of the invention, the operation can conveniently be performed outside the cavity 7 with a view to preparing and assembling the two portions of the block 14 and then introducing the connector terminals 8 into the block after these latter have been connected to the conductors 9. The block 14 is then rapidly installed within the cavity 7 in which its location is defined by the retaining lugs 24 which project within the cavity in order to be engaged in the lateral recessed portions 23 of the anchoring block (FIGS. 3, 4 and 5). All these operations are performed conveniently without any need for tool equipment.

In an advantageous manner, the invention makes it possible to prepare separately the complete subassembly consisting of the motor 5 and its supply conductors 9, the ends 9A of which are fitted with their connector terminals 8 (as shown in FIG. 6). The aforesaid subassembly can thus be conveniently checked beforehand, especially in order to inspect the attachments of connector terminals 8 on the ends 9A of the conductors. In the case of connectors of known types, these operations involving attachment and inspection of the ends 9A must take place within the narrow cavity 7 in a costly and uncertain manner.

By making provision for passages 11B, 11A of sufficient width at both ends of the channel 11, the connector terminals 8 attached to the conductors 9 can conveniently be passed therein by operating in the direction of the arrow F2 (FIG. 6) for the purpose of positioning the conductors.

After insertion of the conductors 9 and installation of the anchoring block 14 within the cavity 7 (FIGS. 1, 2 and 3), the assembly of the connector is completed by inserting the sliding cover-plate 12 into the grooves 17 which extend on each side of the cavity. The cover-plate is displaced until this latter completely covers the block 14 and is locked on this latter in the service position by means of its catch 22A (FIGS. 2 and 6) which is engaged with the recess 22 of the block 14.

The rear oblique extension 19 of the cover-plate is accordingly located in alignment with the sides of the square side plates of the fan housing.

The cover-plate 12 which is tightly fitted on the anchoring block 14 and on the cavity 7 constitutes an undetachable closure element for the connector and cannot be released without causing destruction of the cover-plate.

In fact, the catch 22A which is located near the center of the internal face of the cover-plate 12 (as shown in FIGS. 2 and 5) cannot be reached from the exterior. Moreover, the anchoring block 14 which carries the retaining recess 22 associated with the catch 22A (FIG. 2) is immobilized in the direction of sliding of the cover-plate (arrow $F_1$) by means of the holding lugs 24 which project within the cavity 7 (FIG. 3) and engaged within the recessed portions 23 of the block 14 (FIG. 4).

The connector in accordance with the invention offers a number of advantages.

The connector can readily and economically be manufactured in large-scale production, especially for a flat ventilating-fan which has a thickness of only 25 mm, for example, and calls for an anchoring block 14 (FIG. 4) having a width of approximately 15 mm and a thickness of 6 mm. The two identical portions of the anchoring block can be economically fabricated from molded plastic material.

The invention permits separate preparation of the complete subassembly constituted by the motor 5 and its internal supply leads 9, the ends 9A of which are fitted with their connector terminals 8 (as shown in FIG. 6). Preliminary inspection and testing of the aforesaid subassembly ensure complete safety in regard to subsequent operation of the fan.

In the case of connectors of known types, it proves essential on the contrary to operate within the narrow cavity 7 in order to attach the ends 9A of the conductors to the connecting-tags which are similar to the connector terminals 8. This operation is particularly awkward in the case of a fan of the flat type and cannot readily be checked with accuracy. This often results in costly rejects and in accidental failures during subsequent operation of the fan. Now it is a fact that, as a general rule, the requirements laid down by users call for strict guarantees in regard to operational safety of fans employed for such purposes as the cooling of large and costly electronic equipment units which may have to be kept in service without interruption over long periods of time.

By virtue of the present invention, the connector terminals 8 which have previously been attached to the conductor ends 9A are conveniently positioned prior to installation of the block 14 within the cavity 7. The conductors 9 have the exact length required, are therefore easy to fit in position, can be rapidly and easily assembled; and the same applies to the anchoring block 14 which is locked in position by means of the sliding cover-plate 12.

All the above-mentioned assembly operations are performed without any need for tool equipment and make it possible to achieve a considerable saving of assembly time. Moreover, preliminary inspection and testing of attachments of the ends 9A to the connector terminals permit guaranteed operational safety of the fan.

Unreleasable locking of the cover-plate 12 of the connector represents a further advantage which permits a guaranteed test of the connector in accordance with the invention.

As can readily be understood, the invention is not limited to the embodiment which has just been described by way of example and many alternative embodiments can accordingly be contemplated without thereby departing either from the scope or the spirit of the invention.

In an advantageous manner as illustrated in FIGS. 1 to 3, the connector can comprise an insulating member 31 of molded plastic material, for example, for protecting the fan-housing walls which are adjacent to the connector cavity 7 at the end corresponding to the external portion 8B of each connector terminal 8. Preferably, the insulating member 31 is detachable and is provided (FIG. 3) with two lateral recesses 32. Each recess is adapted to engage in the service position on the holding lugs 24 which project within the cavity 7, in order to fix the insulating member 31 in position at the entrance of the cavity 7.

Another alternative embodiment of the connector in accordance with the invention is illustrated in FIGS. 1, 2 and 6. In this embodiment the connector is associated with a cover-plate 34 which serves to close the channel 11 of the radial arm 6A through which the conductors 9 are passed. The cover-plate 34 is advantageously provided with fixing means associated with the passage 11A for joining the channel 11 to the connector cavity 7. Once the cover-plate 34 is in position, its fixing means can be reached only from the cavity 7. This makes it impossible to remove the cover-plate 34 when the cover-plate 12 of the connector cavity 7 is itself locked in the service position (FIG. 2).

For example, the cover-plate 34 of the arm 6A is formed of molded plastic material endowed with elasticity and is provided with an engagement nose 34A associated with one edge of the passage 11B through which the channel 11 communicates with the axial housing of the motor 5. The cover-plate 34 is also provided with a resilient locking nose 34B associated with one edge of the passage 11A which joins the channel 11 to the connector cavity 7. The locking nose 34B has a projecting tip 34C which is accessible only from the connector cavity 7 when the cover-plate 34 is mounted on the channel 11 in the service position as shown in chain-dotted lines in FIG. 6.

The cover-plate 34 which is tightly fitted over the channel 11 in the service position cannot in any event be removed without causing destruction when the cover-plate 12 of the connector is itself locked in position on the cavity 7 (FIG. 2), thereby preventing any access to the projecting tip 34C of the resilient locking nose 34B of the cover-plate 34.

I claim:

1. An electric power supply connector, especially for a fan of the flat type comprising a hollow housing and a cylindrical shell defining an axial duct for an impeller, said impeller being driven by an electric motor which is secured to the cylindrical shell by means of substantially radial arms, the connector being mounted externally on the cylindrical shell and constituted by a cavity for receiving at least one anchoring block provided with retaining means for an internal portion of each connector terminal which is connected to the motor by means of a conductor placed within a channel of one of the radial arms, the connector terminal being constituted by a projecting external portion which can be connected to an electric power supply, a cover-plate being provided for covering the cavity in the service position as well as maintaining the anchoring block and the end portion of each associated conductor in said position, wherein the anchoring block is made up of two complementary portions which can be interassembled in the service position in order to constitute a housing for retaining the internal portion of each connector terminal, at least one of the complementary portions of the anchoring block being provided with projecting claws which can be engaged and locked on bosses for retaining the other portion in the aforementioned service position.

2. A connector according to claim 1, wherein that portion of the anchoring block which carries the projecting claws is of molded plastic material so as to permit resilient engagement and locking of the claws aforesaid on the retaining bosses of the other portion of said anchoring block.

3. A connector according to claim 2, wherein the two complementary portions of the anchoring block are substantially identical and prismatic, each portion being provided with two projecting and substantially parallel resilient claws disposed along two edges of a first lateral face of the prism aforesaid and with two projecting retaining bosses on a second lateral prism face opposite to the first, the two bosses of one portion of the anchoring block being engageable in the service position between the two resilient claws of the other portion of said block.

4. A connector according to claim 1 for a fan of the flat type comprising a square housing and two side plates each having four corners constituting a radially projecting double frame on the cylindrical shell, the cavity for accommodating the anchoring block being provided with two parallel side grooves for cooperating with two parallel edges of the cover which is slidably mounted within said grooves, the cavity aforesaid being located between two opposite corners of the square side plates, wherein the parallel grooves in which the cover-plate is slidably mounted are formed in the two opposite internal faces of the corners aforesaid on each side of the cavity which is intended to accommodate said anchoring block.

5. A connector according to claim 4, wherein the cover-plate has a rear oblique extension in order to close the cavity which contains the anchoring block, said extension being substantially aligned with the sides of the square side plates of the housing in the service position of said cover-plate.

6. A connector according to claim 4, wherein the anchoring block is provided on a face remote from the cylindrical shell with a retaining recess for resilient engagement of a catch of the cover-plate within said recess in order to maintain said cover-plate locked on the connector cavity in the service position when the anchoring block is mounted within the connector cavity in the normal service position.

7. A connector according to claim 6, wherein the locking catch of the cover-plate is located near the center of that face of the cover-plate which is opposite to the anchoring block, the cover-plate being tightly fitted on the block and on the cavity in the service position.

8. A connector according to claim 4 for a fan having a metallic housing, wherein said connector comprises means for protecting the housing walls adjacent to the oppositely-facing cavity of the external portion of each connector terminal, said means being such as to comprise a detachable covering and insulating member provided with at least one fastening recess adapted to engage in the service position on a holding lug forming a projection within the cavity in order to fasten the insulating member at the entrance of said cavity.

9. A connector according to claim 1 in which a passage is provided within the connector cavity and communicates with the channel of the radial arm for the supply leads to the motor, the channel aforesaid being closed by a cover-plate in the service position of the fan, wherein the channel cover-plate is provided with fixing means associated with the passage for joining said channel to the connector cavity, said fixing means being accessible only from the connector cavity in the service position of said cover-plate on said channel.

* * * * *